US005197246A

United States Patent [19]

Hill

[11] Patent Number: 5,197,246

[45] Date of Patent: Mar. 30, 1993

[54] PANEL

[76] Inventor: Brian P. Hill, 715 W. Fifth St., Erie, Pa. 16507

[21] Appl. No.: 867,445

[22] Filed: Apr. 13, 1992

[51] Int. Cl.[5] ..... E04H 1/00

[52] U.S. Cl. ..... 52/235; 52/486; 52/481

[58] Field of Search ..... 52/346, 347, 364, 479, 52/481, 732, 243, 710, 480, 489, 241, 486, 488, 490, 508, 511, 235

[56] References Cited

U.S. PATENT DOCUMENTS

| | | | |
|---|---|---|---|
| 1,987,568 | 1/1935 | Barge | 52/346 |
| 3,289,372 | 12/1966 | Adams et al. | 52/346 |
| 3,561,182 | 2/1971 | Madl, Jr. | 52/479 |
| 3,621,635 | 11/1971 | de Lange | 52/486 X |
| 3,903,671 | 9/1975 | Cuin et al. | 52/710 X |
| 3,991,252 | 11/1976 | Kolakowski et al. | 428/313 |
| 4,047,355 | 9/1977 | Knorr | 52/738 |
| 4,227,360 | 10/1980 | Balinski | 52/780 |
| 4,418,507 | 12/1983 | Roberts et al. | 52/241 |
| 4,455,801 | 6/1984 | Merritt | 52/309.9 |
| 4,637,187 | 1/1987 | Campbell | 52/404 |
| 4,641,468 | 2/1987 | Slater | 52/309.4 |
| 4,779,392 | 10/1988 | Hopeman | 52/481 |

*Primary Examiner*—David A. Scherbel
*Assistant Examiner*—Creighton Smith
*Attorney, Agent, or Firm*—Lovercheck and Lovercheck

[57] ABSTRACT

A building panel is disclosed having spaced vertically extending panel studs and vertically spaced laterally extended elongated members fixed to the studs. The panel is suitable to be supported on a wall having spaced brackets with upwardly opened channels adapted to receive the elongated members of the panel. The panels can be erected by installing brackets on a wall and lowering the panels so that the elongated members are received in the upwardly opened channels of the brackets.

9 Claims, 1 Drawing Sheet

PANEL

BACKGROUND OF THE INVENTION

This invention relates to building structures and more particularly to a simple, efficient and economical method and structure for building a wall. There is a need for a simple, efficient, economical method, apparatus and structure for erecting buildings.

Applicant is aware of the following U.S. patents which discloses various methods and apparatus for constructing building walls: U.S. Pat. No. 3,991,252 to Kolakowski et al; U.S. Pat. No. 4,047,355 to Knorr; U.S. Pat. No. 4,227,360 to Balinski; U.S. Pat. No. 4,418,507 to Roberts et al; U.S. Pat. No. 4,455,801 to Merritt; U.S. Pat. No. 4,637,187 to Campbell; U.S. Pat. No. 4,641,468 to Slater and U.S. Pat. No. 4,779,392 to Hopeman. None of these references show a method and apparatus such as applicant discloses.

SUMMARY OF THE INVENTION

The present invention involves providing a conventional building frame made up of studs supported on joists. Attaching brackets having upwardly facing channels to the studs and providing panels with vertically spaced elongated members attached to the panel. Supporting the panels on the studs by dropping the elongated members on the panels into the brackets that are supported on the studs.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figures 1, 2, 3:
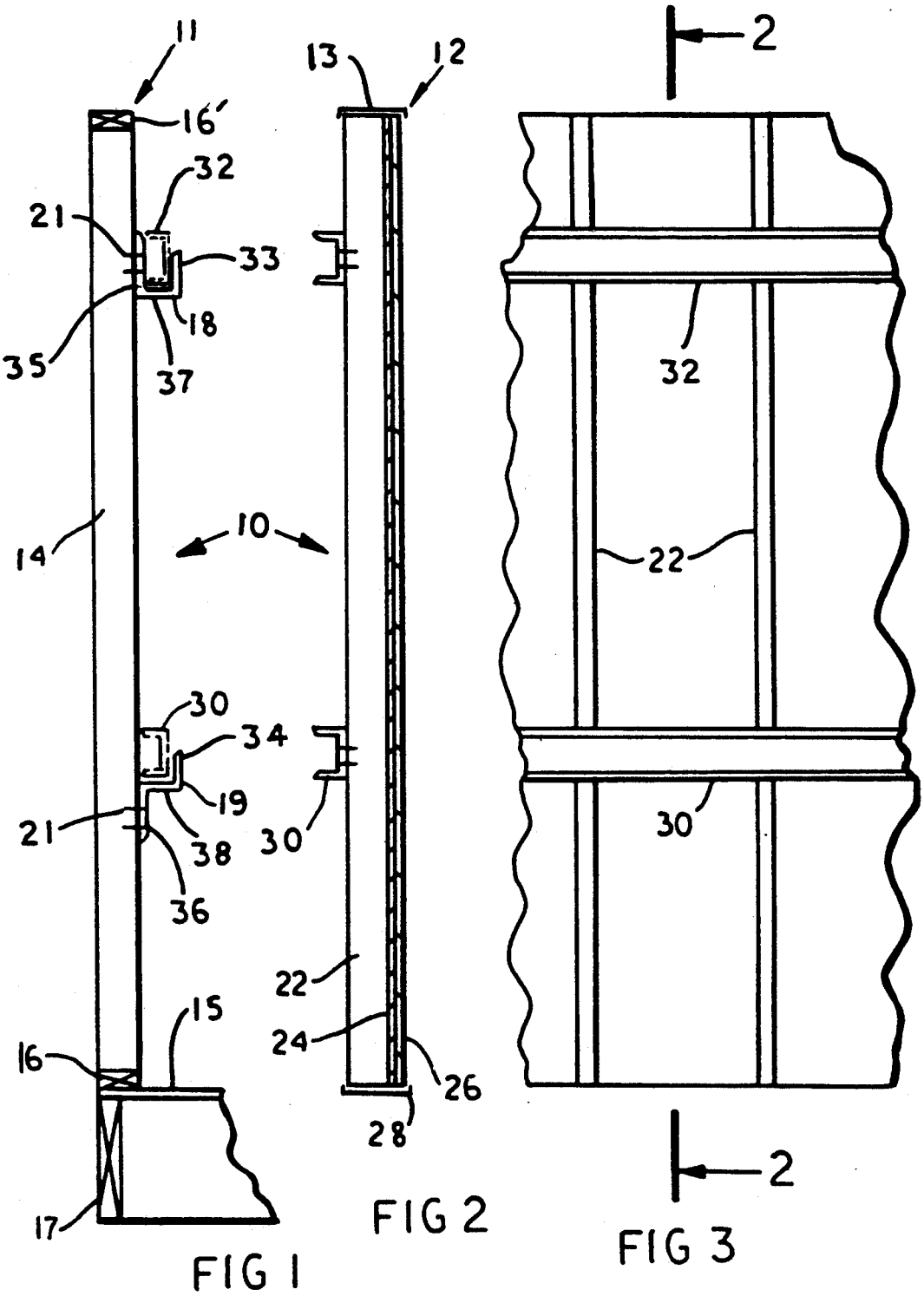
FIG. 1 is an end view of a building frame for supporting panels according to the invention.
FIG. 2 is a longitudinal cross sectional view taken on line 2—2 of FIG. 3.
FIG. 3 is a partial rear view of the panel in accordance with the invention.

Now with more particular reference to the drawings, shown is building frame structure 10 made up of frame 11 and panels 12. Frame 11 is made up of frame studs 14, lower plate 16, upper plate 16', joists 17, upper bracket 18 and lower bracket 19. Joists 17 are assembled in a manner familiar to those skilled in the art.

Floor 15 is supported on joists 17. Lower plate 16 is supported on floor 15 and frame studs 14 are attached to lower plate 16 in conventional spaced relation to one another. Upper plate 16' is attached to the upper end of frame studs 14.

Upper bracket 18 is attached to the upper end of frame studs 14 by nails 21. Upper bracket 18 has first leg 33, second leg 35 and connecting member 37 provides an upwardly facing U-shaped space which receives longitudinally extending upper channel member 32 on panel 12. Lower bracket 19, generally Z-shaped in form, has upper leg 34, lower leg 36 and intermediate member 38. Lower bracket 19 receives lower channel member 30. Longitudinally extending channel members 30 and 32 may be channel shaped in cross section, or any other suitable shape. Upper brackets 18 and lower brackets 19 will be received in the spaces between panel studs 22. Lower bracket 19 is likewise fixed to frame studs 14 by nails 21.

Each panel 12 is made of inner sheet 24 and outer sheet 26 which are attached together and fixed to panel stud 22. Inner sheet 24 may be made of an insulation material and outer sheet 26 may be metal, sheet plastic or any other suitable finishing material.

Channel shaped upper cover member 13 is supported over the upper end of panel 12. Channel shaped lower cover member 28 is received over the lower end of panel 12 for protection against moisture.

During erection, panel 12 is carried to the correct position at which lower channel member 30 is raised above upper brackets 18 and upper channel member 32 is raised above lower bracket 19. Panel 12 is then lowered so lower channel member 30 and upper channel member 32 drop into a U-shaped space in upper bracket 18 and into lower bracket 19, respectfully, thereby, holding panel 12 rigidly in spaced relation to panel stud 22. This assembly method has the advantage that panel 12 can economically be fabricated in a factory, transported to the job site where a building frame structure 10 has been erected, the panel is unloaded and dropped into place on upper bracket 18 and lower bracket 19 and the building can be finished by a workman.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a building structure comprising a frame and a panel;

said frame comprising frame studs, a lower plate, an upper plate, an upper bracket and a lower bracket;

said frame studs having an upper end and a lower end;

said lower end of said frame studs having said lower plate fixed thereto;

said upper end of said frame studs having said upper plate fixed thereto;

said upper bracket being supported on said frame studs and said lower bracket being supported on said frame studs in spaced relation to said upper bracket;

said panel including panel studs;

an upper elongated member fixed to said panel stud which is generally perpendicular thereto;

a lower elongated member fixed to said panel stud generally perpendicular thereto and spaced from said upper elongated member;

said panel adapted to be supported on a wall with said upper elongated member received in said upper bracket and said lower elongated member adapted to be received in said lower bracket on said frame studs whereby said panel is held in place on said wall.

2. The combination recited in claim 1 wherein an inner sheet of building material is fixed to said panel stud and an outer sheet of a finished material is supported on said inner sheet.

3. The combination recited in claim 1 wherein at least one of said brackets is in the form of an upwardly facing channel and having first leg, a second leg spaced from said first leg and a connecting member connecting said first leg to said second leg whereby said bracket is adapted to receive said upper elongated member on said panel; and, said panel being held in position on said panel; and upper bracket.

4. The combination recited in claim 1 wherein said lower bracket is generally Z-shaped having an intermediate member adapted to form a support for said lower elongated member to rest upon;

an upwardly extending leg fixed to said intermediate member adapted to provide a space with said stud adapted to receive said lower elongated member; and, a downwardly extending leg fixed to said intermediate member and fixed to said stud.

5. The combination recited in claim 1 wherein said upper bracket and said lower bracket are supported on said frame stud by nails.

6. The combination recited in claim 5 wherein a channel-shaped upper cover member is supported on an upper end of said panel providing protection from weather and mechanical injury to said panel.

7. The combination recited in claim 6 wherein a channel shaped lower cover member is supported on a lower end of said panel.

8. The combination recited in claim 2 wherein said inner sheet of building material on said panel stud is an insulation sheet.

9. The combination recited in claim 2 wherein said outer sheet comprises a weather proof material.

* * * * *